US006393643B1

(12) United States Patent
Wientjens

(10) Patent No.: US 6,393,643 B1
(45) Date of Patent: May 28, 2002

(54) METHOD AND SYSTEM FOR WASHING TEXTILE AND THE LIKE

(76) Inventor: Gerardus Theodorus Antonius Maria Wientjens, Sprokkelveld 9, NL-6596 DH Milsbeek (NL)

( * ) Notice: Subject to any disclaimer, the term of this patent is extended or adjusted under 35 U.S.C. 154(b) by 0 days.

(21) Appl. No.: 08/979,103

(22) Filed: Nov. 26, 1997

(30) Foreign Application Priority Data

Nov. 27, 1996 (NL) ..... 1004629

(51) Int. Cl.[7] ..... D06F 39/10
(52) U.S. Cl. ..... 8/159; 68/18 F; 68/902
(58) Field of Search ..... 8/158, 159; 18/18 F; 134/111; 68/902

(56) References Cited

U.S. PATENT DOCUMENTS 3,973,987 A * 8/1976 Hewitt et al.
4,165,288 A * 8/1979 Teed et al.
4,312,634 A * 1/1982 Katz
4,975,199 A * 12/1990 Woster et al.
5,241,843 A * 9/1993 Hein ..... 68/902
5,285,665 A * 2/1994 Hetrick, Jr. ..... 68/902
5,307,650 A * 5/1994 Mertz ..... 68/902
5,617,885 A * 4/1997 Centis ..... 68/902
5,787,537 A * 8/1998 Mannillo ..... 8/159

FOREIGN PATENT DOCUMENTS

| | | |
|---|---|---|
| DE | 3513940 | 12/1985 |
| EP | 0467028 | 1/1992 |
| EP | 0578006 | 1/1994 |

* cited by examiner

*Primary Examiner*—Frankie L. Stinson
(74) *Attorney, Agent, or Firm*—Webb Ziesenheim Logsdon Orkin & Hanson, P.C.

(57) ABSTRACT

The invention relates to a method for washing textile and the like, especially in large scale industrial applications, and to a system for carrying out this method.

10 Claims, 4 Drawing Sheets

METHOD AND SYSTEM FOR WASHING TEXTILE AND THE LIKE

BACKGROUND OF THE INVENTION

1) Field of the Invention

The present invention relates to a method for washing textile and the like, especially in large scale industrial applications, and to a system for carrying out this method.

2) Prior Art

Water is one of the most important elements in a washing process whereby the object is to clean articles, for example textile, subjected to said process. As well as water, the washing result is dependent on other factors such as wash temperature, detergent and the mechanical action of washing.

There is a growing need for improved wash processes, especially with a particular emphasis on reducing the amount of water used due to the scarcity thereof in particular areas, and during hot seasons. Methods are also currently sought for reducing the amount of detergent used in order to prevent environmental problems which result when the detergent is released into the environment after use.

In certain areas of England for example, water is rationed during hot summers leading to problems for laundromats and industrial laundries.

Furthermore in some remote areas with poor access, such as the Greek islands, water has to be transported there by truck. This means that when this water is finished, there is a shortage of water until the next delivery. This is especially a problem for hotel laundries on such islands.

Moreover the price of water is ever increasing so that ways to reduce water usage are becoming increasingly sought after.

Due to these problems, much research has been done into the recycling of water in washing processes.

An existing method for treating water in a washing machine is described in the European patent application 0 467 028 from Zanussi.

SUMMARY OF THE INVENTION

This application describes a method for filtering water by means of reverse osmosis for domestic washing machines and dish washers, which has the object of softening the water, so that the amount of detergent necessary to provide an effective wash can be reduced. Purified water from the reverse osmosis step is stored in a tank until needed in the washing machine.

The concentrate from the reverse osmosis filter (which contains contaminants) is guided away, and kept in a separate tank such that this concentrate can be used for carrying out the first rinse cycle on a subsequent wash program.

Water from the last rinse from the previous wash program is returned to the first tank from where water is guided to the reverse osmosis unit whereby about 20% of the water in any giving wash program is recycled.

An object of the present invention is to provide an improved washing process wherein water is recycled for reuse in both main wash and rinse cycles while retaining and reusing heat in water.

According to a first aspect the present invention provides a process for washing objects such as textile and the like, comprising the steps of:

a) guiding water and detergent into a washing machine;

b) carrying out one or more wash and/or rinse cycles In the machine;

c) guiding the water from step b) into a reverse osmosis unit, where the water is subjected to reverse osmosis in order to remove contaminants from the water;

d) recycling water front step c) into the washing machine for use by one or more wash and/or rinse cycles wherein substantially all the recycled water is subjected to the reverse osmosis step c).

A significant saving in water and energy is provided with this process, with a reverse osmosis unit, contamination with a molecular weight of <100 can be separated.

The recycled water is preferably used in at least two separate rinse cycles, and most preferably in a subsequent washing program.

Rinsing consumes a large part of the water necessary in washing processes especially with white wash for example for hotel and hospital linen. Until now, waste water from washing machines has not been resused for rinsing this sort of textile washed in the machine due to the risk of textile damage. In general, fresh mains water is used for this.

The water quality requirements for rinsing are different than for the use of water by other wash program phases. One of the main differences in the quality requirements of rinse water is the salt content thereof. If this salt content is too high in the so-called finishing equipment, it is difficult to treat the textile, whereby brown stains are caused on the textile which can also yield skin irritations. Waste water from the washing process has a high salt content mainly due to the salts present in the detergent. On using the process according to the present invention purified water can however be recycled for reuse in the rinsing phases where the main part of water is required for an individual program.

It is preferable to subject water which enters the washing cycle for the first time to a pre-treatment step (for example pre-filtration), before it enters the washing machine.

BRIEF DESCRIPTION OF THE DRAWINGS

Further details, characteristics and advantages of the present invention are laid out in the claims and the following specific description which refers to the figures wherein:

DETAILED DESCRIPTION OF THE PREFERRED EMBODIMENTS

Figure 1:
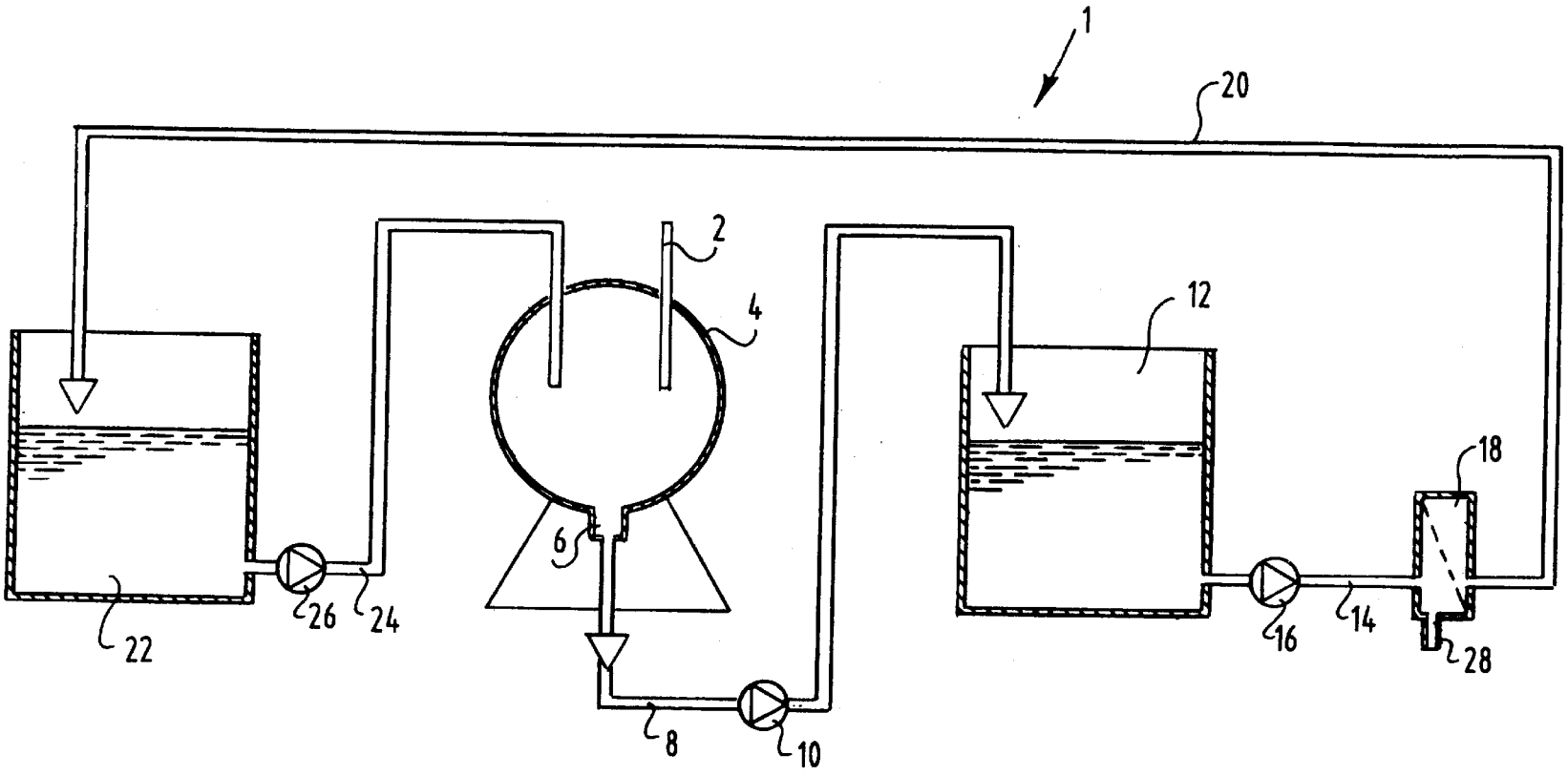
FIG. 1 schematically shows a first embodiment of a system of apparatus for carrying out the process according to the present invention.

Mains water is guided through a conduit 2 into a washing machine 4 (FIG. 1). A pre-treatment unit (not shown) is arranged in this conduit 2. Used washing water is guided from the washing machine 4 through a waste water outlet 6 into a second conduit 8 whereafter it is pumped into a first reservoir 12 by means of a pump 10. Water is pumped through a conduit 14 from the reservoir 12, by means of the pump 16, into a reverse osmosis unit 18 where the washing water is purified and salt is removed from it. This purified water is pumped from the reverse osmosis unit 18 into a second reservoir 22 via a third conduit 20. From this reservoir 22, this water is pumped back into the washing machine 4 by means of the pump 26 through a conduit 24 for reuse. As the water is directly re-used, there is effectively no build up of undesirable smells which could transfer to the washed textiles.

During a washing program any additionally required water can be supplied to the machine through the conduit 2. The required amount of fresh mains water is dependent on the amount of water that remains in the textile after removal from the machine following washing and centrifuging, as well as the water remaining behind in the concentrate, which is guided away from the reverse osmosis separating unit 18 via the conduit 28. Since the contaminant concentrate is removed from the recycled water no substantial build up of salt occurs.

This concentrate is preferably brought to a biological break-down unit where it can be biologically broken down by micro-organisms. Due to the relatively small volume of concentrate, the required amount of buffered water is greatly reduced by contrast to existing systems; buffer tanks with a capacity of roughly 2–3 $m^3$ can be used instead of 600–800 $m^3$.

The system 30 (FIG. 2) comprises twice the system apparatus as the system according to FIG. 1, i.e. comprises two reservoirs and one reverse osmosis unit for treating waste water separately from the pre-wash and waste water from the main wash (2–28, 2–28') respectively, in order to optimize the system with respect to quality requirements. A filter unit for removing coarser material, for example a micro or ultra filtration unit, can be added on the waste water unit in order to further improve the process.

With respect to FIG. 1, calculations have demonstrated the following water and energy savings.

Saving Calculation for FIG. 1:

TABLE 1

Washing process for standard white wash on a washer-extractor

| | 1/kg IN | 1/kg OUT | Temperature ° C. | Delta T |
|---|---|---|---|---|
| Pre-wash | 4 | 3 | 35 | 25 |
| Main wash | 3 | 3 | 70 | 60 |
| Rinse 1 | 5 | 5 | 36 | 26 |
| Rinse 2 | 5 | 5 | 36 | 26 |
| Rinse 3 neutral | 5 | 5.4 | 36 | 26 |
| Remaining moisture in the textile | 0.6 | | | |
| Total water consumption | 22 | | | |
| Total water discharge | | 21.4 | | |

Water Saving

A recovery of 70% means that a saving of roughly 68% is achieved on the total water consumption, i.e. 14.98 l.

Energy Saving

In existing systems a determined heat content is discharged into the sewer. If one takes a reference temperature of 10° C. for incoming mains water, 2752.68 kJ of heat are discharged per kg textile.

If that water is recycled according to the system of the present invention, 6.42 l at 40° C. are discharged. This has a heat content of 808,92 kJ/kg textile. This represents a saving of 71% with respect to the existing situation.

Figure 2:
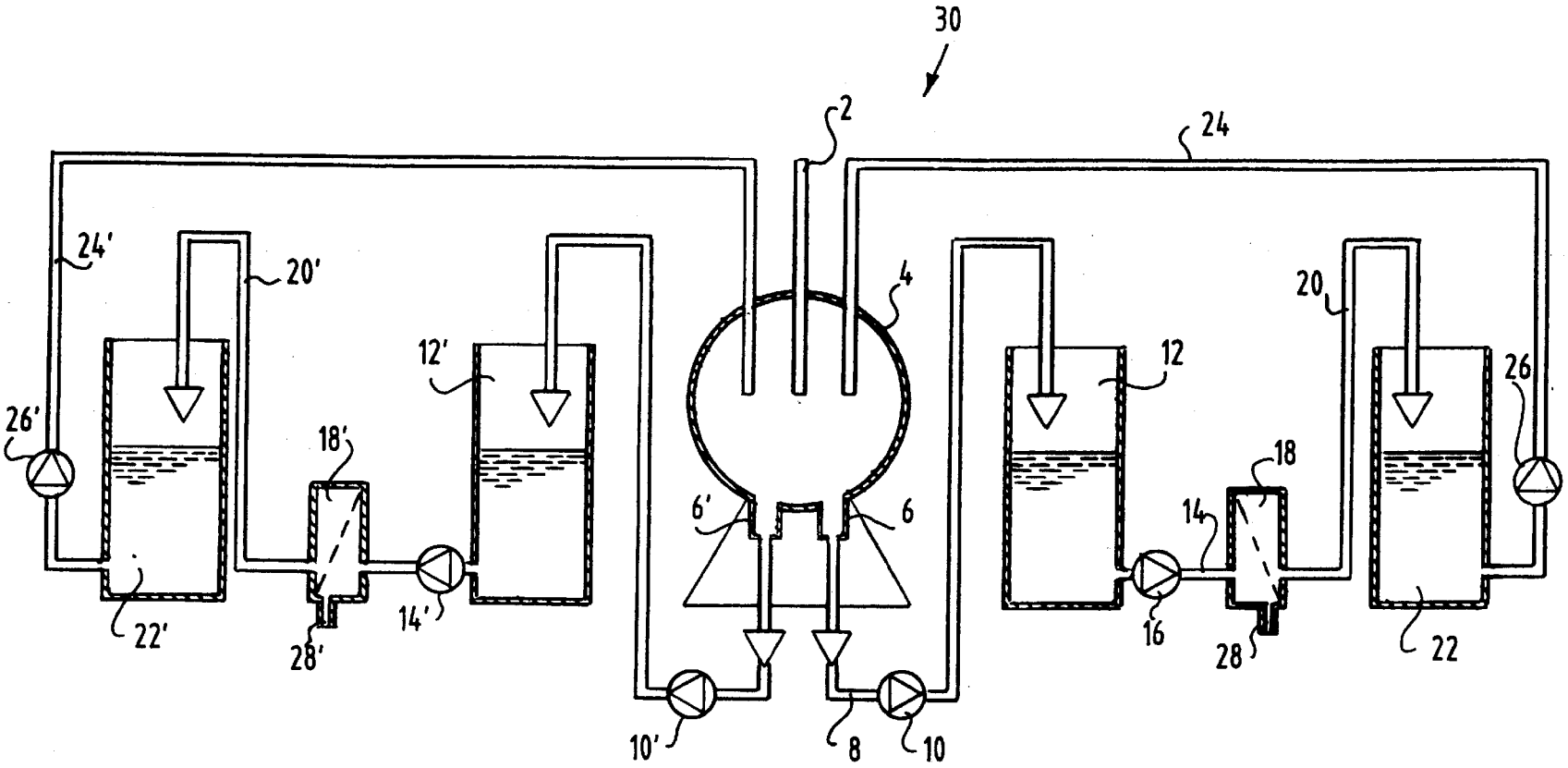
FIG. 2 schematically shows a second embodiment of a system of apparatus for carrying out the process according to the present invention.

Savings Calculation for FIG. 2:

When one carries out the same calculations for FIG. 2, wherein the waste water from the pre-wash is separately treated, a water saving of 72% with respect to the total water consumption is achieved.

In this case the energy saving is 75%

Furthermore the waste water purification is more economical since filtration of water from the pre-wash can be carried out more easily and cheaply. This is due to the lower requirements with respect to the reuse of water for a pre-wash.

Experimental

Table 2 shows experimental results from a wash program carried out in a system according to FIG. 1.

TABLE 2

| | Time in minutes | Temperature in ° C. | Water consumption in liters water per kg textile | Water supplied from the mains | Water supplied from the filter unit |
|---|---|---|---|---|---|
| Soak | 0.5 | | | | |
| Pre-wash | 12 | 31 | 4 | 1 | 3 |
| Drain | 0.5 | | | | |
| Main wash | 10 | 70 | 4 | | 4 |
| Drain | 0.5 | | | | |
| 1. rinse | 4 | 50 | 6 | | 6 |
| Intermediate centrifuge | 2 | | | | |
| 2. rinse | 4 | 30 | 7 | | 7 |
| Intermediate centrifuge | 2 | | | | |
| 1. rinse | 4 | 15 | 7 | 6 | 1 |
| End centrifuge | 10 | | | | |
| Total | 49.5 | | 28 | 7 | 21 |

The average temperature of the water from the filter unit was 36° C.

Of the water provided for filtering, roughly 75% is filtered and reused in the washing process. In the residue, being 25% (concentrate), the contamination was present which was filtered out.

In the soak/pre-wash only 3 liters of water, coming from the filter unit, was used per kg textile so that due to the addition of mains water the temperature in the bath is somewhat reduced.

In the pre-wash phase the dose of detergent used is roughly 20 g of detergent per kg of textile, and another 12.5 g of detergent er kg textile is supplied in the main wash.

A batch washing installation 50 (FIG. 3) consists of a soaking compartment 52, a main wash compartment 54, a rinse compartment 56, and a neutralizing compartment 58, which controls the pH.

In working, typically 4 $m^3$/hour is taken from the soak compartment 52, this being stream 59, and 6 $m^3$/hour is taken from the main wash compartment 54, this being stream 60, these two streams 59, 60 respectively being combined to form stream 61 which is guided into a storage tank 62.

From the storage tank 62, stream 64 is pumped through pump 66 at a rate of 10 $m^3$/hour to emerge as stream 68 which is guided through a course filter unit 70, Stream 72 emitting from the filter 70 is guided into a second storage tank 74.

Stream 75 is guided from this second storage tank 74 and pumped through a second pump 76 at a rate of 10 $m^3$/hour (stream 77).

This stream 77 is guided into a reverse osmosis unit 78. A concentrate stream 80 comprising undesirable contaminants and salts, is guided away from the reverse osmosis unit 78 at a rate of 2 $m^3$/hour.

A purified stream 82 is guided away from the osmosis unit 78 at a rate of 8 $m^3$/hour into a third storage tank 84, into which fresh mains water 86 at a rate of 2 $m^3$/hour is also guided.

Stream 88 is guided from the storage tank 84 through a pump 90, the stream 92 being pumped by pump 90 at a rate of 10 $m^3$/hour back into the batch washer 50 to a compartment of choice.

Figure 3:
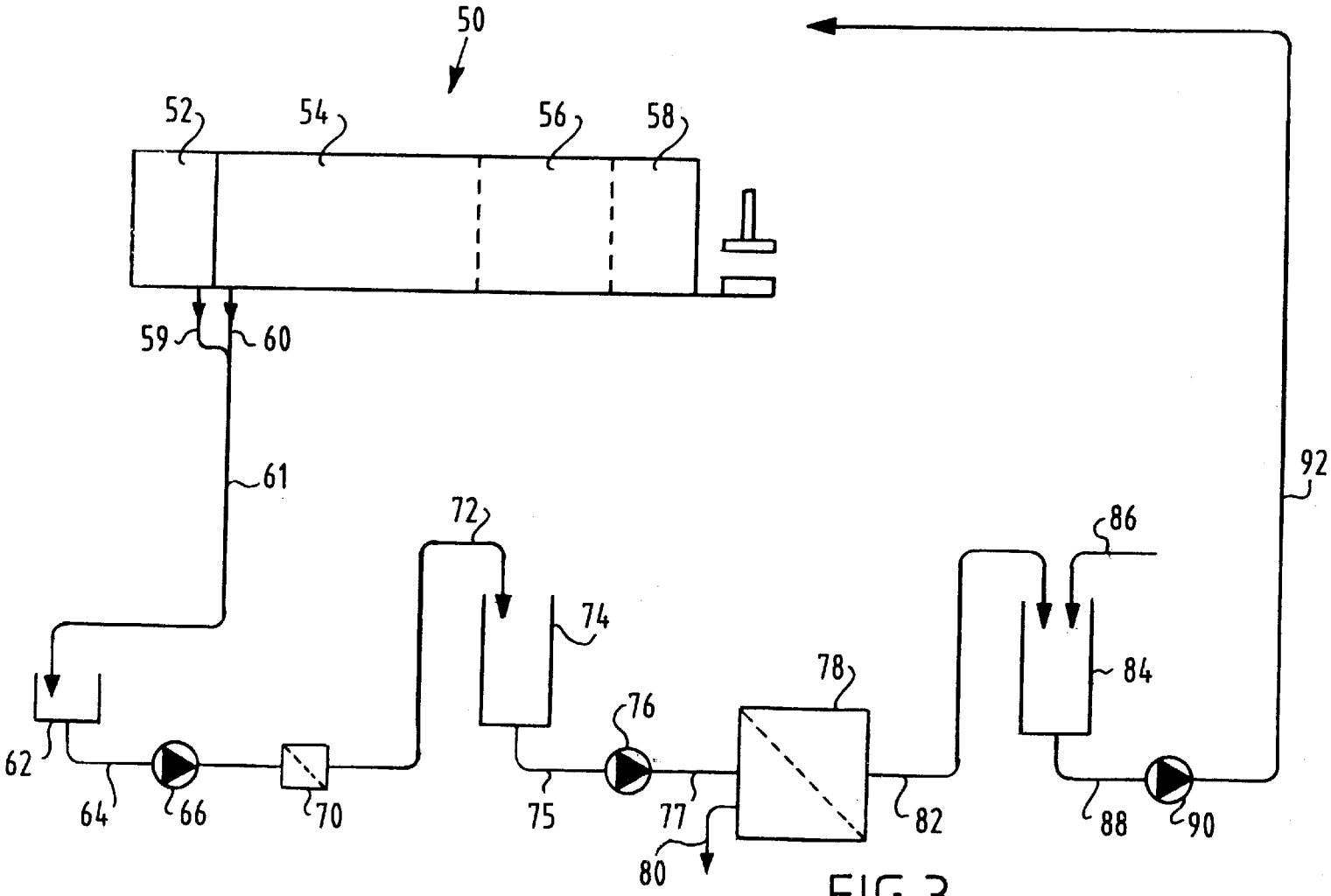
FIG. 3 schematically shows a working embodiment of a system of apparatus according to the present invention.
Figure 4:
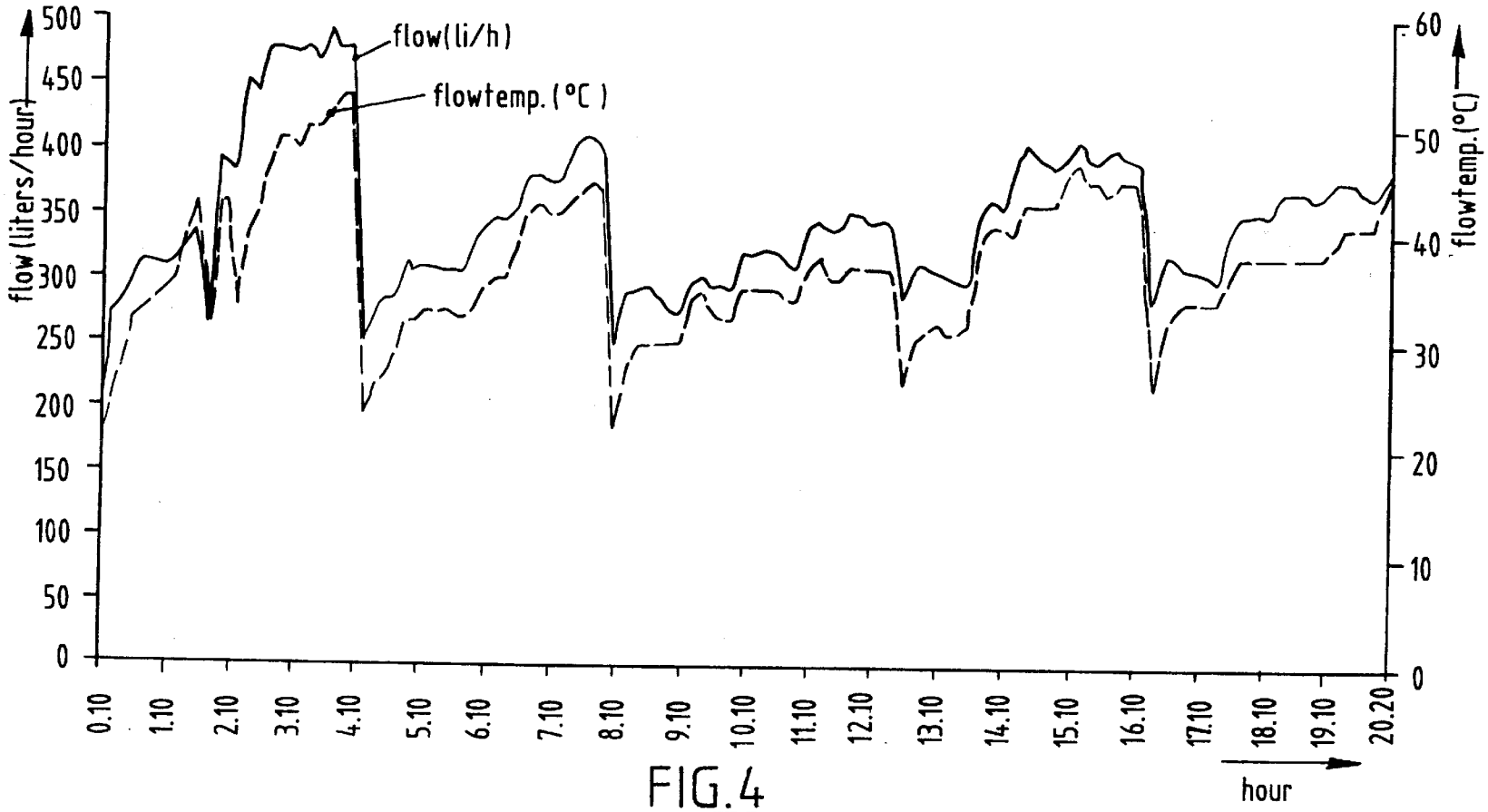
FIG. 4 is a graph showing the capacity per hour of a plant as schematically shown in FIG. 3.

FIG. 4 shows the flow rate and flow temperature of the streams as measured in the system as shown in FIG. 3 during a period of 20 hours.

The invention is not limited to the above description, the requested rights are rather determined by the following claims.

What is claimed is:

1. A process for washing objects such as textile, comprising the steps of:

a) supplying recycled water, make-up fresh mains water, and detergent into a washing machine;

b) carrying out one or more washing and/or rinsing cycles in the washing machine utilizing the recycled and make-up fresh main water of step a);

c) guiding used waste wash water generated at step b) into a reverse osmosis filter unit where the waste wash water is subjected to reverse osmosis in order to remove contaminants from the waste wash water thereby forming a stream of the recycled water; and d) continuously recycling the stream of recycled water formed in step c) directly into the washing machine at step a) for use in the one or more washing and/or rinsing cycles of step b), wherein substantially all the waste wash water from step b) is subjected to the reverse osmosis of step c), and wherein a total volume of the stream of recycled water supplied to the washing machine at step a) has passed through the reverse osmosis of step c).

2. The process according to claim 1, wherein the recycled water is used in at least two separate rinsing cycles.

3. The process according to claim 1, wherein the recycled water is used in each subsequent washing cycle at step b).

4. The process according to claim 1, wherein the make-up fresh mains water is subjected to a pre-treatment step before being supplied into the washing machine.

5. The process according to claim 1, wherein concentrate comprising contaminants generated by the reverse osmosis filter unit in step c) is guided out of the reverse osmosis filter unit and is subsequently subjected to a biological break down step.

6. The process according to claim 1, wherein of the waste water provided at step c) for reverse osmosis filtering approximately 75% is returned to step a) as recycled water.

7. The process according to claim 1, wherein the energy saving with each subsequent washing cycle at step b) using the stream of recycled water is at least about 50%.

8. An apparatus for washing objects such as textile, comprising:

a washing machine having a waste water outlet;

a first conduit for guiding fresh mains water into the washing machine; and a reverse osmosis filter unit located upstream of the washing machine and connected to the waste water outlet of the washing machine for receiving waste water from a washing and/or rinsing cycle carried out in the washing machine, with the reverse osmosis filter unit configured to filter the waste water from the washing machine and form a stream of recycled water, and with the reverse osmosis filter unit having an outlet connected to the washing machine for supplying the stream of recycled water directly to the washing machine such that each washing and/or rinsing cycle carried out in the washing machine utilizes at least in part recycled water.

9. The apparatus according to claim 8, further comprising a reservoir located between the washing machine and the reverse osmosis filter unit for storing the waste water from the washing machine prior to entering the reverse osmosis filter unit, with the reservoir in fluid communication with the washing machine through the waste water outlet and in fluid communication with the reverse osmosis filter unit through an inlet to the reverse osmosis filter unit.

10. The apparatus according to claim 9, further comprising a second reservoir located at the outlet of the reverse osmosis filter unit for storing the recycled water generated by the reverse osmosis filter unit prior to entering the washing machine, with the second reservoir having an outlet connected to the washing machine for supplying the recycled water to the washing machine.

* * * * *